US006911877B2

(12) United States Patent
Bickford

(10) Patent No.: US 6,911,877 B2
(45) Date of Patent: Jun. 28, 2005

(54) COPLANAR WAVEGUIDE LAUNCH PACKAGE

(75) Inventor: Joel D. Bickford, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 137 days.

(21) Appl. No.: 10/376,679

(22) Filed: Feb. 26, 2003

(65) Prior Publication Data

US 2004/0164818 A1 Aug. 26, 2004

(51) Int. Cl.[7] ..... H01P 5/06
(52) U.S. Cl. ..... 333/33; 439/581; 333/243
(58) Field of Search ..... 333/33, 243, 260; 439/581

(56) References Cited

U.S. PATENT DOCUMENTS 4,593,243 A * 6/1986 Lao et al. ..... 324/754
4,754,239 A 6/1988 Sedivec ..... 333/26
5,897,384 A * 4/1999 Hosler, Sr. ..... 439/63
6,362,703 B1 * 3/2002 Keesey et al. ..... 333/33
6,396,363 B1 5/2002 Alexanian et al. ..... 333/26
6,512,431 B2 1/2003 Pergande ..... 333/246
2004/0038587 A1 * 2/2004 Yeung et al. ..... 439/581

* cited by examiner

*Primary Examiner*—Dinh T. Le

(57) ABSTRACT

A signal transition device such as a coplanar waveguide launch package is disclosed. The coplanar waveguide launch package has a first portion and a second portion. The first portion is adapted to receive electrical signals from a conductive wire. The received signals terminate proximal to a launch at a first surface of the first portion. The second portion, connected to the first portion, has a support surface at a substantially normal angle. The support surface of the second portion is adapted to support a coplanar waveguide. Because the coplanar waveguide launch package of the present invention does not require removing of bottom portions of the coplanar waveguide launch package, it does not require machining of the bottom-side, does not require removal of the bottom-side material, and does not require a bottom lid.

15 Claims, 4 Drawing Sheets

COPLANAR WAVEGUIDE LAUNCH PACKAGE

BACKGROUND

The present invention relates generally to an electronic interconnect packaging technology. More specifically, the present invention relates to a coplanar waveguide launch package technology.

As illustrated in FIG. 1 (in a perspective view), for various purposes such as testing and measurements, high frequency electronic signals carried on a coaxial transmission line 10 need to be coupled to a coplanar waveguide 20. The transmission line 10 type is often referred to as "coaxial transmission line" or "coax" for short, and the signal is voltage on a center conductor wire 12 relative to an outer ground shield 13. The coplanar waveguide 20 typically includes a signal trace 22 and ground traces 24 separated from the signal trace 22, both fabricated on an insulating substrate 26.

The coax 10 and the coplanar waveguide 20 are not connected directly. Rather, the signal coupling from the coax 10 to coplanar waveguide 20 is accomplished using a coplanar waveguide package 30 as illustrated in FIGS. 2A and 2B. For frequencies above 10 GHz, as illustrated in FIG. 2A (in a perspective view), the coplanar waveguide package 30 is typically machined from its top-side to the mounting flanges 36 and from its bottom-side (or under-side) to the mounting flanges 36 resulting in a top-side cavity 32 and a bottom-side cavity 34. The coplanar waveguide 20 is attached to the flanges 36, in the bottom-side cavity 34, to the coplanar waveguide package 30 with solder or conductive adhesive allowing the ground traces 24 to make electrical contact with the coplanar waveguide package 30.

The coax 10 connects to the coplanar waveguide launch package 30 via a connector (not shown in the perspective drawing of FIG. 2A. The signal is transferred from the center conductor wire 12 of FIG. 1 to a pin 15 (illustrated in FIG. 2B), the pin 15 terminating at a launch 38 and meeting the signal trace 22 at the launch 38. The launch 38 generally refers to the area of the coplanar waveguide package 30 where the pin 15 contacts the signal trace 22. The launch 38 is illustrated in more detail, in FIG. 2B. The ground shield 13 of the coax 10 is electrically connected to the coplanar waveguide package, the pin 15 being insulated from the coplanar waveguide package 30. Thus, the coplanar waveguide package 30 is the "ground" relative to the pin 15 and the signal trace 22 of the coplanar waveguide 20.

In order to minimize signal reflections at the launch 38, the pin 15 and the signal trace 22 need be precisely aligned in all three dimensions. For this reason, the top-side cavity 32 and the bottom-side cavity 34 must be machined very precisely relative to each other. This is difficult to achieve leading to relatively high cost of manufacture of the coplanar waveguide package 30. Further, the removal of much material of the coplanar waveguide package 30 to create the bottom-side cavity 34 leaves little material to support mounting of components on the coplanar waveguide package 30. Finally, the coplanar waveguide package 30 needs a bottom-lid (not shown) to enclose the bottom-side cavity 34 for environmental and electrical shielding of the bottom-side of the coplanar waveguide package 30. The lid requirement adds to the cost of the manufacture of the coplanar waveguide package 30.

Consequently, there remains a need for better coplanar techniques and devices to minimize power consumption while providing sufficient responses to users.

SUMMARY

The need is met by the present invention. In a first embodiment of the present invention, a signal transition device includes a first portion and a second portion connected to the first portion. The first portion is adapted to receive electrical signals, the signals transferred to a launch proximal to a first surface of the first portion. The second portion, connected to the first portion, has a support surface at a substantially normal angle relative to the first surface. The second portion is adapted to support a coplanar waveguide.

In a second embodiment of the present invention, a coplanar waveguide launch package includes a pin that terminates proximal to a first surface of the coplanar waveguide launch package and a support surface. The pin is adapted to carry electrical signals. The support surface at a substantially normal angle relative to the first surface. The support surface is adapted to support a coplanar waveguide.

In a third embodiment of the present invention, a microcircuit package includes a coplanar waveguide launch package. The coplanar waveguide launch package includes a first portion and a second portion connected to the first portion. The first portion is adapted to receive electrical signals, the signals transferred to a launch proximal to a first surface of the first portion. The second portion, connected to the first portion, has a support surface at a substantially normal angle relative to the first surface. The second portion is adapted to support a coplanar waveguide.

Other aspects and advantages of the present invention will become apparent from the following detailed description, taken in conjunction with the accompanying drawings, illustrating by way of example the principles of the invention.

DETAILED DESCRIPTION

As shown in the figures for the purposes of illustration, one embodiment of the present invention is exemplified by a coplanar waveguide launch package having a first portion and a second portion. The first portion is adapted to receive electrical signals from a conductive wire. The received signals terminate proximal to a launch at a first surface of the first portion. The second portion, connected to the first portion, has a support surface forming a junction with the first surface at a substantially normal angle. The support surface of the second portion is adapted to support a coplanar waveguide.

Because the coplanar waveguide launch package of the present invention does not require removing of bottom portions of the coplanar waveguide launch package, it overcomes the shortcoming of the coplanar waveguide launch packages having prior art designs. In particular, unlike a coplanar waveguide launch package of the prior art design, the coplanar waveguide launch package of the present invention does not require machining of the bottom-side, does not require removal of the bottom-side material, and does not require a bottom lid.

Using the coplanar waveguide launch package of the present invention, signals carried on a coaxial transmission line can be transitioned to a coplanar waveguide. For this reason, the coplanar waveguide launch package of the present invention is also referred to as a signal transition device.

Figure 3A:
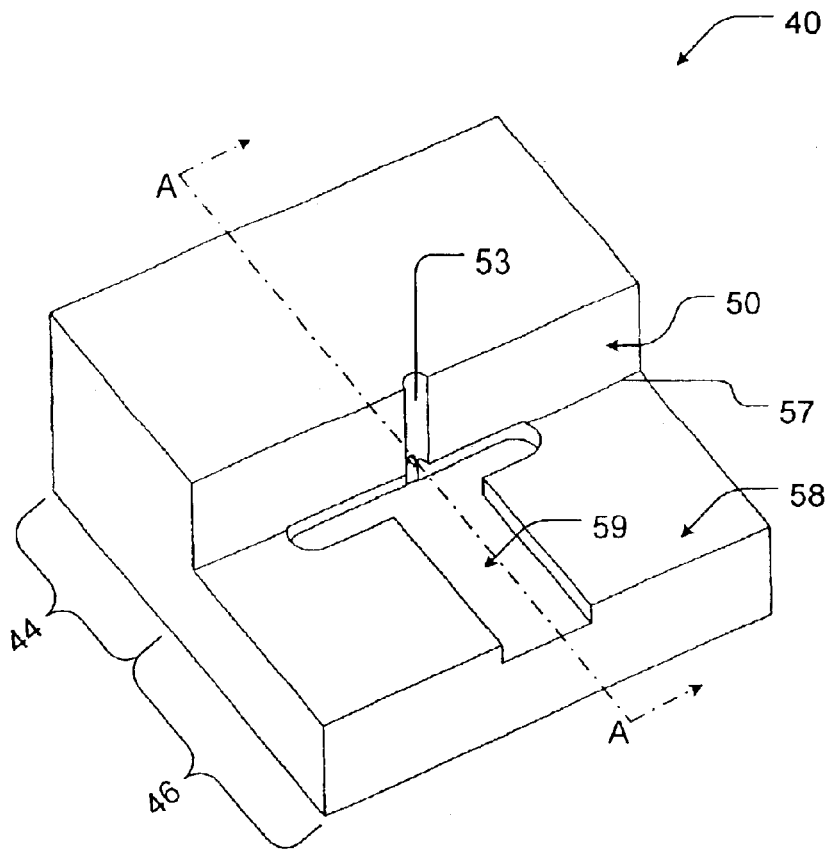
FIG. 3A illustrates a perspective view of one embodiment of a coplanar waveguide package of the present invention with a coplanar waveguide.
Figure 3B:
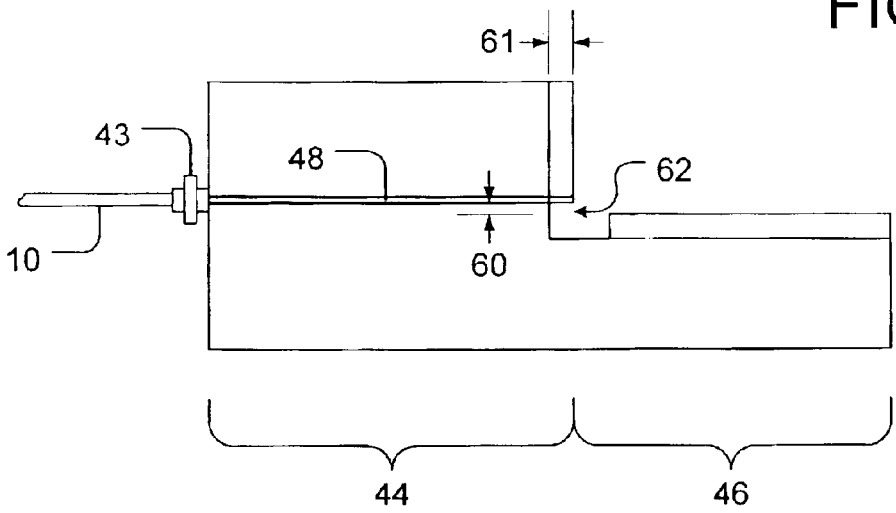
FIG. 3B illustrates cutaway side view of the coplanar waveguide package illustrated in FIG. 3A cut along line A—A.
Figure 3C:
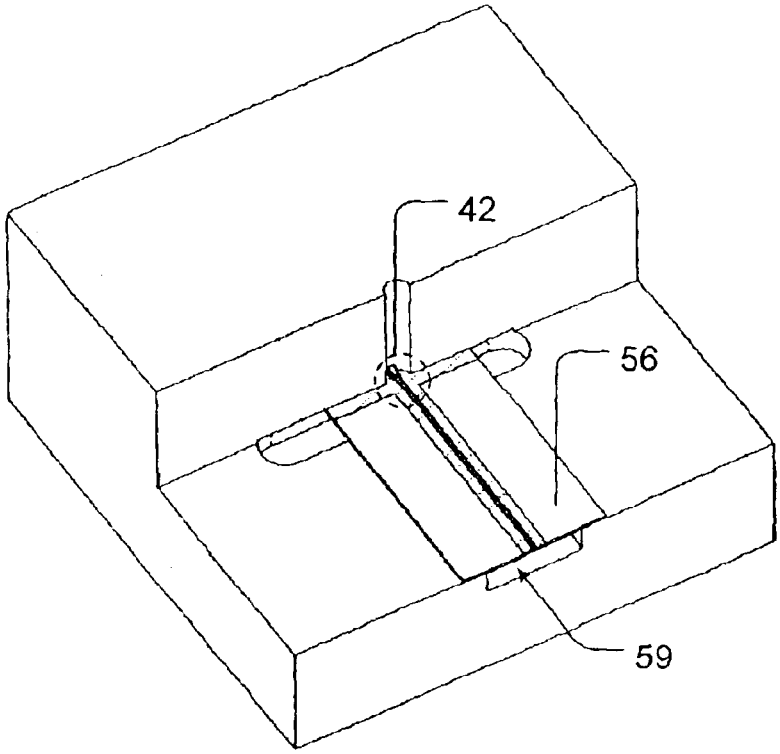
FIG. 3C illustrates the coplanar waveguide package illustrated in FIG. 3A with a coplanar waveguide.
Figure 3D:
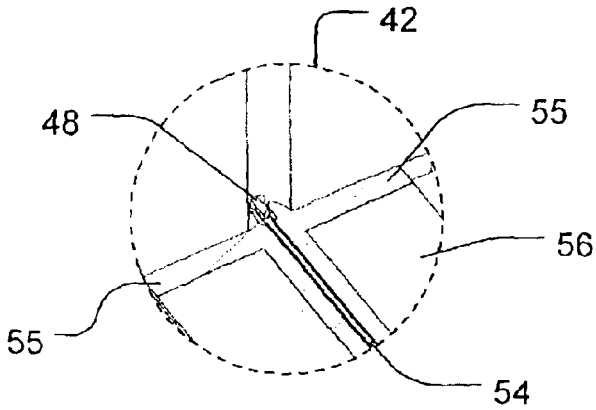
FIG. 3D illustrates a portion of the coplanar waveguide package illustrated in FIG. 3C with a coplanar waveguide cutaway side view, the portion illustrated in more detail.

FIG. 3A illustrates a perspective view of one embodiment of the coplanar waveguide launch package 40 of the present invention. FIG. 3B illustrates a cutaway side view of the coplanar waveguide launch package 40 cut along line A—A shown in FIG. 3A. FIG. 3C illustrates the same perspective view of the coplanar waveguide launch package 40 but including a coplanar waveguide 56. FIG. 3D illustrates launch portion 42 of the coplanar waveguide launch package 40 with a coplanar waveguide 56.

Figure 1:
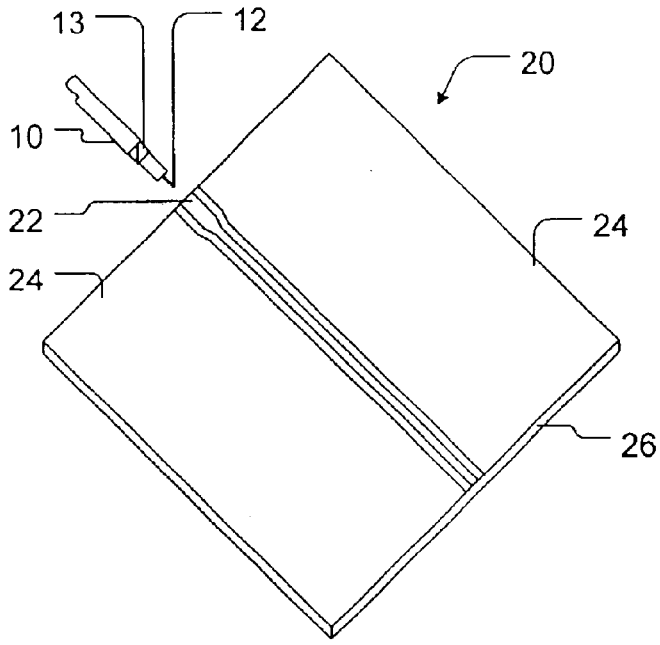
FIG. 1 (Prior art)
FIG. 1 illustrates coax transmission line and a coplanar waveguide.

Referring to FIGS. 3A through 3D, the coplanar waveguide launch package 40 includes a first portion 44 and a second portion 46. The first portion 44 is adapted to receive electrical signals from, for example, a coax 10. The coax 10 having similar configuration as the coax 10 illustrated in FIG. 1 and discussed above. A connector 43 can be used as a transition means to transfer the signals from the center conductor wire 13 (illustrated in FIG. 1) to a pin 48 of the first portion 44. The pin 48 terminates at the launch 42 transferring the signals to the launch 42 at a first surface 50 of the first portion 44. The launch 42 refers to generally portions of the coplanar waveguide package 40 where the pin 48 connects with a signal trace 54 of a coplanar waveguide 56 thereby allowing the signals to be launched onto the coplanar waveguide 56. FIG. 3D illustrates the launch 42 in greater detail. The first surface 50 defines a vertical cut-out relief 53.

The second portion 46 is connected to the first portion 44. The second portion 46 has a support surface 58 that meets the first surface 50 at a substantially normal angle thereby forming a junction 57 with the first surface 50. That is, the support surface 58 meets the first surface 50 at a perpendicular angle forming the junction 57. The meeting of the two surfaces 50 and 58 defines a line 57. The support surface 58 is adapted to support a coplanar waveguide 56 as illustrated in FIG. 3C.

A part of the first portion 44 is undercut forming an overhanging ledge proximal to the junction between the first surface 50 and the support surface 58. The part of the first portion 44 effected by the undercut thus creating the overhanging ledge is generally indicated by reference numeral 62. The reference numeral 62 is used herein this document to referred to the undercut, the overhang, and the overhanging ledge. When the coplanar waveguide 56 is placed on the support surface 58 as illustrated in FIG. 3C, a portion of the coplanar waveguide 56 is received under the overhanging ledge 62 providing stability of the coplanar waveguide 56 as well as creating electrical contacts between the coplanar waveguide 56 and the coplanar waveguide launch package 40. In particular, when the coplanar waveguide 56 is placed on the support surface 58, the signal trace 54 of the coplanar waveguide 56 is positioned proximal to the pin 48. Further, ground traces 55 of the coplanar waveguide 56 make contact with the first portion 44 of the coplanar waveguide launch package 40.

Figure 4:
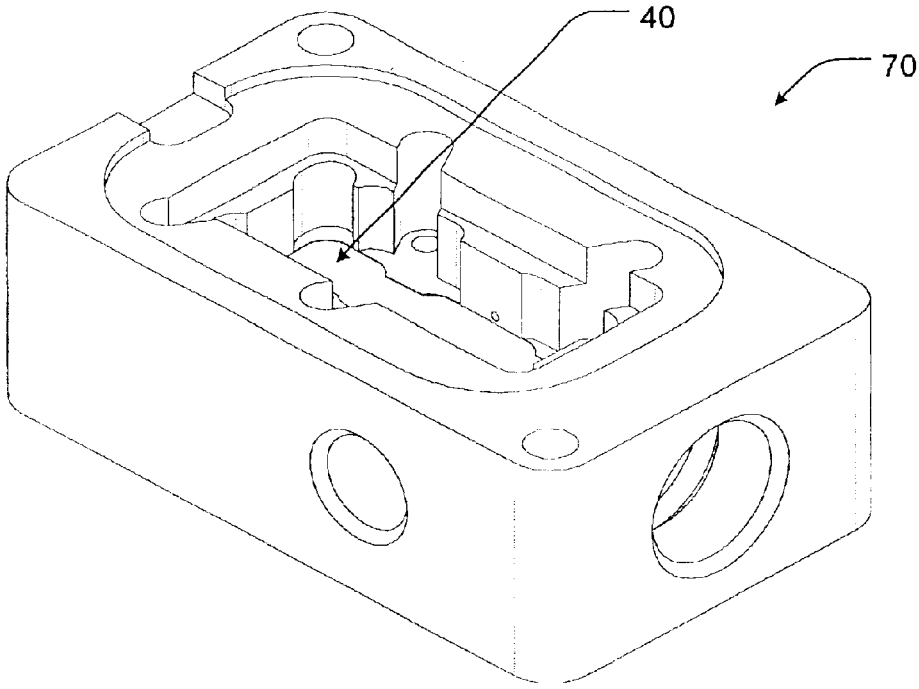
FIG. 4 illustrates a microcircuit package including the coplanar waveguide package illustrated in FIG. 3A.

The depth 60 of the undercut 62 is substantially greater than or equal to the thickness of the coplanar waveguide 56 which can be, for example, a fraction of a millimeter. The width 61 of the undercut 62 is substantially equal to the depth of the vertical cut-out relief 53 which can be, for example a fraction of a millimeter. The exact size depends on the frequency range, substrate thickness, mechanical mounting, and other considerations. The support surface 58 defines a bottom side gap 59. The space defined by the bottom side gap 59 can be utilized by a T-slot cutter bit to mill the undercut 62. As illustrated in the Figures, the coplanar waveguide launch package 40 including the first portion 44 and the second portion 46 is machined from a single block of material. In fact, the coplanar waveguide launch package 40 can be a part of a larger microcircuit package 70 as illustrated in FIG. 4. Referring to FIG. 4, the microcircuit package 70 can include additional components in addition to the coplanar waveguide launch package 40. Further, the microcircuit package 70 can be formed from a single block of material.

Figure 2A:
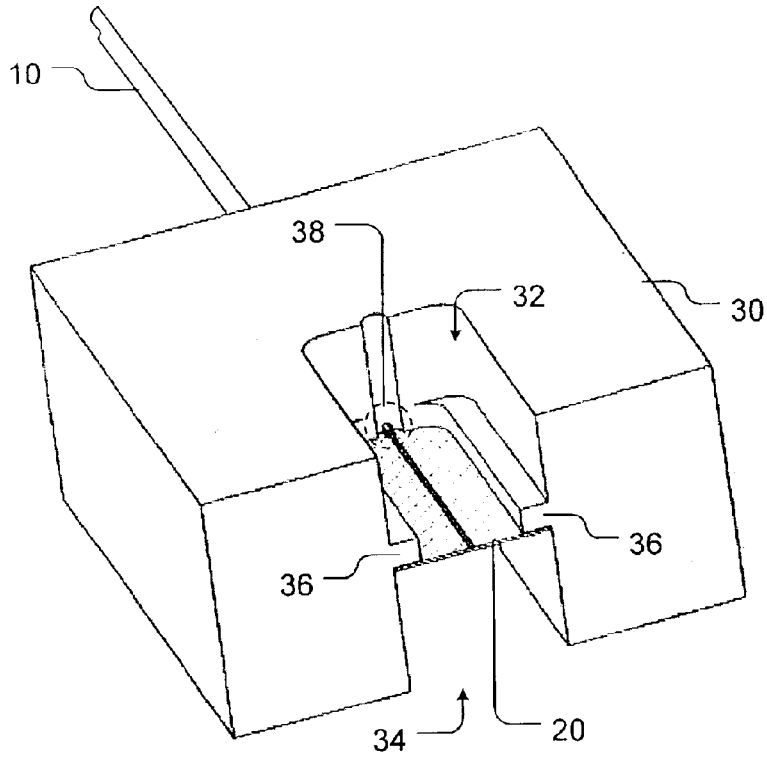
FIG. 2A (Prior art)
FIGS. 2A and 2B illustrate a prior art coplanar waveguide package with a coplanar waveguide.
Figure 2B:
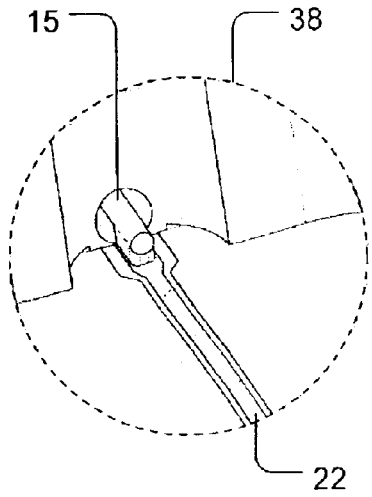
FIG. 2B (Prior art)

Because the coplanar waveguide launch package 40 of FIGS. 3A through 4 of the present invention does not require removing of bottom portions, it overcomes the shortcoming of the coplanar waveguide launch packages having prior art designs. In particular, unlike a coplanar waveguide launch package 30 (of FIGS. 2A and 2B) of the prior art design, the coplanar waveguide launch package 40 (of FIGS. 3A through 4) of the present invention does not require machining of the bottom-side, does not require removal of the bottom-side material, and does not require a bottom lid.

From the foregoing, it will be apparent that the device of the present invention is novel and offers advantages over the current art. Although a specific embodiment of the invention is described and illustrated above, the invention is not to be limited to the specific forms or arrangements of parts so described and illustrated. The invention is limited only by the claims.

What is claimed is:

1. A signal transition device comprising:

a first portion adapted to receive electrical signals, the signals transferred to a launch proximal to a first surface of said first portion;

a second portion, connected to said first portion, said second portion having a support surface at a substantially normal angle compared to the first surface, said second portion adapted to support a coplanar waveguide;

wherein the first surface and said second surface define a junction; and wherein said first portion is undercut proximal to said junction forming an overhanging ledge adapted to secure a portion of the coplanar waveguide.

2. The signal transition device recited in claim 1 further comprising a coplanar waveguide on said support surface.

3. The signal transition device recited in claim 1 wherein said first surface defines a vertical cut-out relief.

4. The signal transition device recited in claim 1 wherein said support surface defines a bottom side gap.

5. The signal transition device recited in claim 1 wherein said first portion and said second portion is machined from a single block of material.

6. A coplanar waveguide launch package comprising:

a pin terminating proximal to a first surface of the coplanar waveguide launch package, said pin adapted to carry electrical signals; and a support surface at a substantially normal angle compared to the first surface, said support surface adapted to support a coplanar waveguide; and wherein the first surface is undercut proximal to a line, defined by a meeting of the first surface and said support surface; the undercut creating an overhanging ledge adapted to receive a portion of said coplanar waveguide.

7. The coplanar waveguide launch package recited in claim 6 wherein said pin and a coplanar waveguide connect at a launch.

8. The coplanar waveguide launch package recited in claim 6 further comprising a coplanar waveguide on said support surface.

9. The coplanar waveguide launch package recited in claim 6 wherein the first surface defines a vertical cut-out relief.

10. The coplanar waveguide launch package recited in claim 6 wherein said support surface defines a bottom side gap.

11. A microcircuit package comprising a coplanar waveguide launch package, the coplanar waveguide launch package comprising:

a first portion adapted to receive electrical signals, the signals transferred to a launch proximal to a first surface of said first portion;

a second portion, connected to said first portion, said second portion having a support surface forming at a substantially normal angle compared to the first surface, said second portion adapted to support a coplanar waveguide;

wherein the first surface and said second surface define a junction; and wherein said first portion is undercut proximal to said junction forming an overhanging ledge adapted to secure a portion of the coplanar waveguide.

12. The microcircuit package recited in claim 11 further comprising a coplanar waveguide on said support surface.

13. The microcircuit package recited in claim 11 wherein said first surface defines a vertical cut-out relief.

14. The microcircuit package recited in claim 11 wherein said support surface defines a bottom side gap.

15. The microcircuit package recited in claim 11 wherein said microcircuit package is machined from a single block of material.

* * * * *

UNITED STATES PATENT AND TRADEMARK OFFICE

CERTIFICATE OF CORRECTION

PATENT NO. : 6,911,877 B2
DATED : June 28, 2005
INVENTOR(S) : Bickford

It is certified that error appears in the above-identified patent and that said Letters Patent is hereby corrected as shown below:

Column 5,
Line 8, after "line" delete ",".
Line 11, after "surface" delete ";" and insert -- , --.
Line 12, delete "said" and insert -- the --.

Signed and Sealed this

Seventeenth Day of January, 2006

JON W. DUDAS
*Director of the United States Patent and Trademark Office*